US008079409B2

(12) United States Patent
Ishimori et al.

(10) Patent No.: US 8,079,409 B2
(45) Date of Patent: Dec. 20, 2011

(54) EGR COOLER

(75) Inventors: Takashi Ishimori, Hino (JP); Yoji Yamashita, Hidaka (JP)

(73) Assignees: Hino Motors, Ltd., Hino-shi (JP); Sankyo Radiator Co., Ltd., Iruma-shi (JP)

( * ) Notice: Subject to any disclaimer, the term of this patent is extended or adjusted under 35 U.S.C. 154(b) by 795 days.

(21) Appl. No.: 12/088,988

(22) PCT Filed: Oct. 6, 2006

(86) PCT No.: PCT/JP2006/320058

§ 371 (c)(1), (2), (4) Date: Aug. 14, 2008

(87) PCT Pub. No.: WO2007/043456

PCT Pub. Date: Apr. 19, 2007

(65) Prior Publication Data

US 2009/0229802 A1 Sep. 17, 2009

(30) Foreign Application Priority Data

Oct. 7, 2005 (JP) ..... 2005-295010

(51) Int. Cl.
*F28F 9/20* (2006.01)
*F28F 1/00* (2006.01)

(52) U.S. Cl. ..... 165/158

(58) Field of Classification Search ..... 165/157, 165/158, 177, 109.1, 179, 184; 138/38, 42; 123/568.12

See application file for complete search history.

(56) References Cited

U.S. PATENT DOCUMENTS

| | | | | |
|---|---|---|---|---|
| 2,252,045 | A * | 8/1941 | Spanner | 138/38 |
| 3,826,304 | A * | 7/1974 | Withers et al. | 165/179 |
| 4,330,036 | A * | 5/1982 | Satoh et al. | 165/179 |
| 5,680,772 | A * | 10/1997 | Furukawa et al. | 62/476 |
| 7,080,634 | B2 * | 7/2006 | Yamashita | 123/568.12 |
| 7,171,956 | B2 * | 2/2007 | Igami et al. | 123/568.12 |
| 2003/0111210 | A1 * | 6/2003 | Tsujita et al. | 165/51 |
| 2005/0150648 | A1 * | 7/2005 | Dilley et al. | 165/184 |

FOREIGN PATENT DOCUMENTS

| | | |
|---|---|---|
| JP | 11 108578 | 4/1999 |
| JP | 2000 345925 | 12/2000 |
| JP | 2001 254649 | 9/2001 |
| JP | 2001 304047 | 10/2001 |
| JP | 2001304047 A * | 10/2001 |
| JP | 2001 342909 | 12/2001 |
| JP | 2004 28376 | 1/2004 |

* cited by examiner

*Primary Examiner* — Tho V Duong

(74) *Attorney, Agent, or Firm* — Oblon, Spivak, McClelland, Maier & Neustadt, L.L.P.

(57) ABSTRACT

An exhaust gas recirculation (EGR) cooler includes a plurality of tubes and a shell enclosing the tubes. During use, cooling water is supplied to and discharged from the shell, and exhaust gas is guided from a diesel engine into the tubes to be heat exchanged with the cooling water. An inner periphery of each of the tubes is formed with three streaks of spiral protrusions running without crossing and with phases peripherally shifted to each other. A pitch P ratio of each of the spiral protrusions to an inner diameter of each of the tubes is 2.0-4.0, and a ridge height H ratio of each of the spiral protrusions to the inner diameter of each of the tubes is 0.1-0.2.

1 Claim, 4 Drawing Sheets

EGR COOLER

TECHNICAL FIELD

The present invention relates to an EGR cooler associated with an EGR apparatus, which recirculates exhaust gas from a diesel engine to suppress generation of nitrogen oxides, so as to cool the exhaust gas for recirculation.

BACKGROUND ART

Known is an EGR apparatus which recirculates part of exhaust gas from an engine in a vehicle or the like to the engine to suppress generation of nitrogen oxides. Some of such EGR apparatuses are equipped with, midway of an exhaust gas recirculation line to the engine, an EGR cooler for cooling the exhaust gas since cooling the exhaust gas to be recirculated to the engine will drop the temperature of and reduce the volume of the exhaust gas to lower the combustion temperature in the engine without substantial decrease in output of the engine, thereby effectively suppressing generation of nitrogen oxides.

FIG. 1 is a sectional view showing an example of the EGR coolers in which reference numeral 1 denotes a cylindrical shell with axially opposite ends to which plates 2 are respectively fixed to close the ends of the shell 1. Penetratingly fixed to the respective plates 2 are opposite ends of a number of tubes 3 which extend axially within the shell 1.

Attached to the shell 1 from outside are cooling water inlet and outlet pipes 4 and 5 near one and the other ends of the shell 1, respectively, so that cooling water 9 is fed via the inlet pipe 4 into the shell 1, flows outside of the tubes 3 and is discharged via the outlet pipe 5 outside of the shell 1.

The respective plates 2 have, on their sides away from the shell 1, bowl-shaped hoods 6 fixed to the respective plates 2 so as to enclose end faces of the plates. The one and the other hoods 6 provide central exhaust-gas inlet and outlet 7 and 8, respectively, so that exhaust gas 10 from the engine enters via the inlet 7 into the one hood 6, is cooled during passage through the number of tubes 3 by means of heat exchange with cooling water 9 flowing outside of the tubes 3 and is discharged to the other hood 6 to be recirculated via the outlet 8 to the engine.

In the figure, reference numeral 11 denotes a bypass outlet pipe arranged at a position diametrically opposed to the cooling water inlet pipe 4, part of the cooling water 9 being withdrawn through the bypass outlet pipe 11 so as to prevent the cooling water 9 from stagnating at the position diametrically opposed to the cooling water inlet pipe 4.

Such conventional EGR cooler has poor heat exchange efficiency since the exhaust gas 10 may flow straight in the tubes 3 and insufficiently contact inner peripheries of the tubes 3. Therefore, it has been proposed that an inner periphery of each of the tubes 3 is formed with spiral protrusions to causes the exhaust gas 10 passing through each of the tubes 3 to whirl, thereby increasing contact frequency and contact distance of the exhaust gas 10 to the inner periphery of each of the tubes 3 to enhance the heat exchange efficiency of the EGR cooler (see, for example, References 1 and 2).

[Reference 1] JP 2000-345925A

[Reference 2] JP 2001-254649A

SUMMARY OF THE INVENTION

Problems to be Solved by the Invention

However, a design concept conventionally adopted for formation of spiral protrusions on the inner periphery of each of the tubes 3 is such that a pitch ratio of the spiral protrusions to an inner diameter of each of the tubes (an inclination angle of the spiral protrusion or protrusions to a plane perpendicular to an axis of each of the tubes 3) is minimized in merely focusing attention on initial performance value. It has been revealed from experimental results by the inventors that application of such design concept to an diesel engine, from which the exhaust gas 10 with much sooty contents is discharged, unsmooths the flow of the exhaust gas 10, resulting in accumulation of soot within the tubes 3 with lapse of time and thus substantial lowering of the heat exchange efficiency.

The invention was made in view of the above and has its object to provide an EGR cooler which can be satisfactorily applied to an diesel engine with no substantial lowering in performance.

Means or Measures for Solving the Problems

The invention is directed to an EGR cooler comprising tubes and a shell enclosing said tubes, cooling water being supplied to and discharged from said shell, exhaust gas being guided from a diesel engine into said tubes to be heat exchanged with said cooling water, characterized in that an inner periphery of each of said tubes is formed with three streaks of spiral protrusions running without crossing and with phases peripherally shifted or displaced with each other, a pitch ratio of each of said spiral protrusions to an inner diameter of each of said tubes being 2.0-4.0, a ridge height ratio of each of said spiral protrusions to said inner diameter of each of said tubes being 0.1-0.2.

Such pitch ratio of each of the spiral protrusions to the inner diameter of each of the tubes set to 2.0-4.0 is slightly inferior in initial performance value on heat exchange efficiency to a pitch ratio of less than 2.0, but increases the tendency of each of the spiral protrusions slanting in the direction of the exhaust gas flow to keep the exhaust gas having less pressure loss and make the exhaust gas flow more smoothly with tendency of the soot being not accumulated on the inner periphery of each of the tubes, and therefore is superior in eventual performance value on heat exchange efficiency after final deterioration; in view of long use thereafter, it turns out that available is a prolonged time period with sufficient heat exchange efficiency maintained.

In fact, it has been ascertained by the inventors' experiments that the pitch ratio of each of the spiral protrusions to the inner diameter of each of the tubes set to less than 2.0 increases the pressure loss with the tendency of soot being accumulated in the tubes, resulting in substantial lowering in performance. It has been also ensured that, with the pitch ratio of each of the spiral protrusions being in a range of 2.0-4.0, the eventual performance value after final deterioration substantially stays flat.

On the other hand, it has been ensured that even with the pitch ratio of more than 4.0, it hardly contributes to lowering in pressure loss of the exhaust gas while an amount of heat exchanged tends to be drastically decreased by slight increase in pitch ratio (a number of whirl of the exhaust gas tends to be decreased due to excess slant of the spiral protrusions in the direction of the exhaust gas flow); moreover, insufficient whirling force afforded to the exhaust gas excessively impairs the action of the soot entrained in the exhaust gas gathering to the whirling axis, resulting inversely in a tendency of the soot to be accumulated on the inner periphery of each of the tubes.

According to the invention, the inner periphery of each of the tubes is formed with three streaks of spiral protrusions running without crossing and with phases peripherally shifted to each other. This enables the mutual distance between the respective protrusions to be decreased with the pitch ratio of each of the spiral protrusions being more than 2.0, whereby whirling force of the exhaust gas can be increased without increasing the pressure loss.

Theoretically, the more the number of streaks of spiral protrusions is, the more they work effectively. However, to machine three streaks of protrusions is actual limitation in current machining technology. It turns out that, at a practical level, such machining of three streaks of spiral protrusions can maximize eventual performance value after final deterioration.

Upon setting the pitch ratio of each of the spiral protrusions to 2.0-4.0, it is preferable that a ridge height ratio of each of the spiral protrusions to the inner diameter of each of the tubes is set to 0.1-0.2. It has been ascertained by the inventors that, with the ridge height ratio being less than 0.1, whirling flow of the exhaust gas is hard to be sufficiently formed, resulting in lowering of an amount of heat exchanged to a minimum level; to increase the ridge height ratio to more than 0.2 is actually unattainable due to productive limitation.

EFFECTS OF THE INVENTION

As is clear from the foregoing, various excellent features and advantages may be obtained according to an EGR cooler of the invention.

(I) For improvement of heat exchange efficiency by means of whirling flow of the exhaust gas in the tubes, the pitch ratio of each of the spiral protrusions to the inner diameter of each of the tubes is set to 2.0-4.0 and the ridge height ratio of each of the spiral protrusions to the inner diameter of each of the tubes is set to 0.1-0.2, so that the soot can be suppressed from being accumulated on the inner periphery of each of the tubes. Thus, an EGR cooler can be provided which can keep performance value higher after final deterioration in comparison with an EGR cooler with the conventional design concept merely focusing attention on initial performance value and which is satisfactorily applicable to a diesel engine with highly sooty exhaust gas being discharged without substantial lowering in performance.

(II) The three streaks of spiral protrusions are formed on the inner periphery of each of the tubes so as to run without crossing and with phases peripherally shifted to each other. As a result, while the pitch ratio of each of the spiral protrusions is set to more than 2.0, mutual distance between the respective spiral protrusions can be decreased and whirling force of the exhaust gas can be increased without pressure loss.

EXPLANATION OF THE REFERENCE NUMERALS

Figure 1:
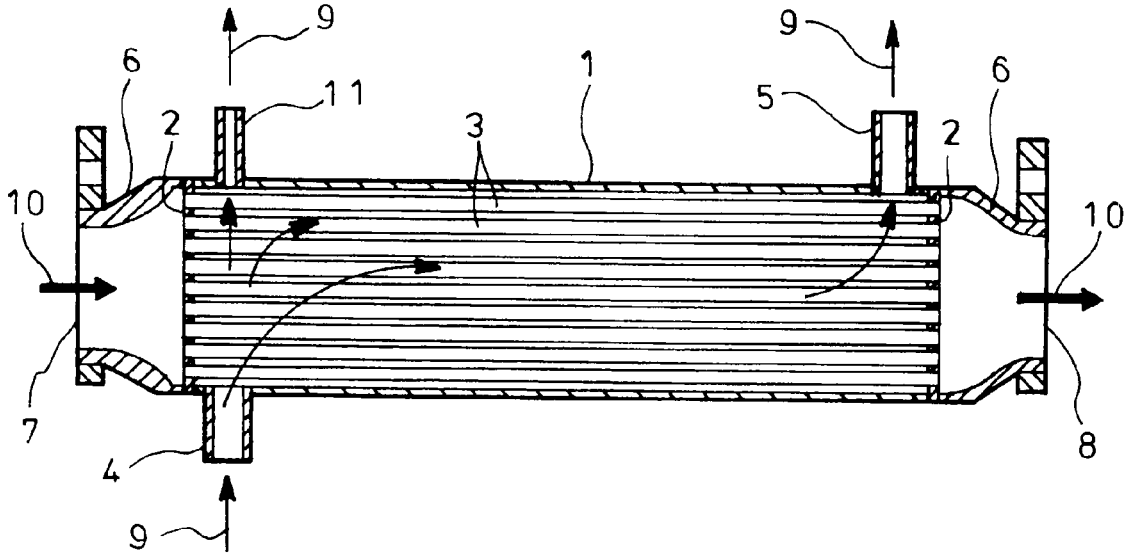
FIG. 1 is a sectional view showing a conventional EGR cooler.

1 shell
3 tube
9 cooling water
10 exhaust gas
12 spiral protrusion
13 spiral protrusion
14 spiral protrusion
D inner diameter of tube
H ridge height
P pitch

BEST MODE FOR CARRYING OUT THE INVENTION

An embodiment of the invention will be described in conjunction with drawings.

Figure 2:
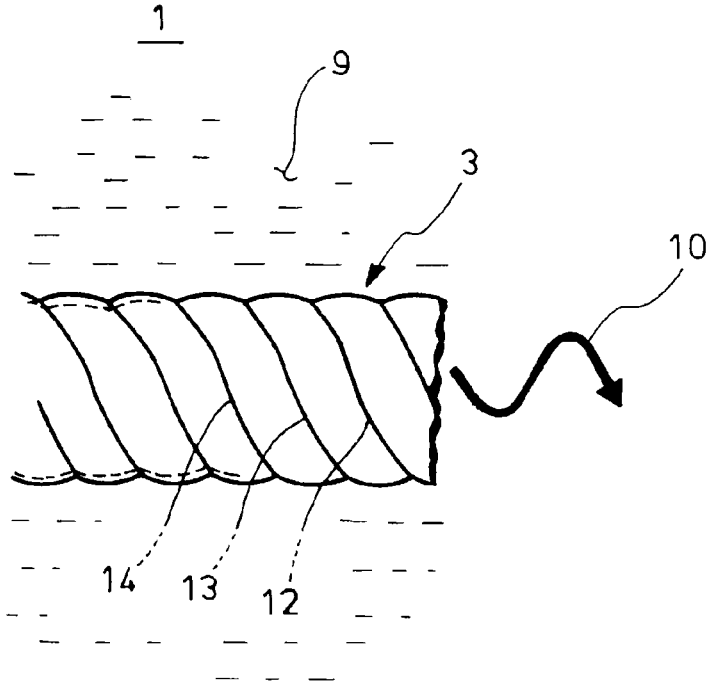
FIG. 2 is a side view showing an embodiment of the invention.
Figure 3:
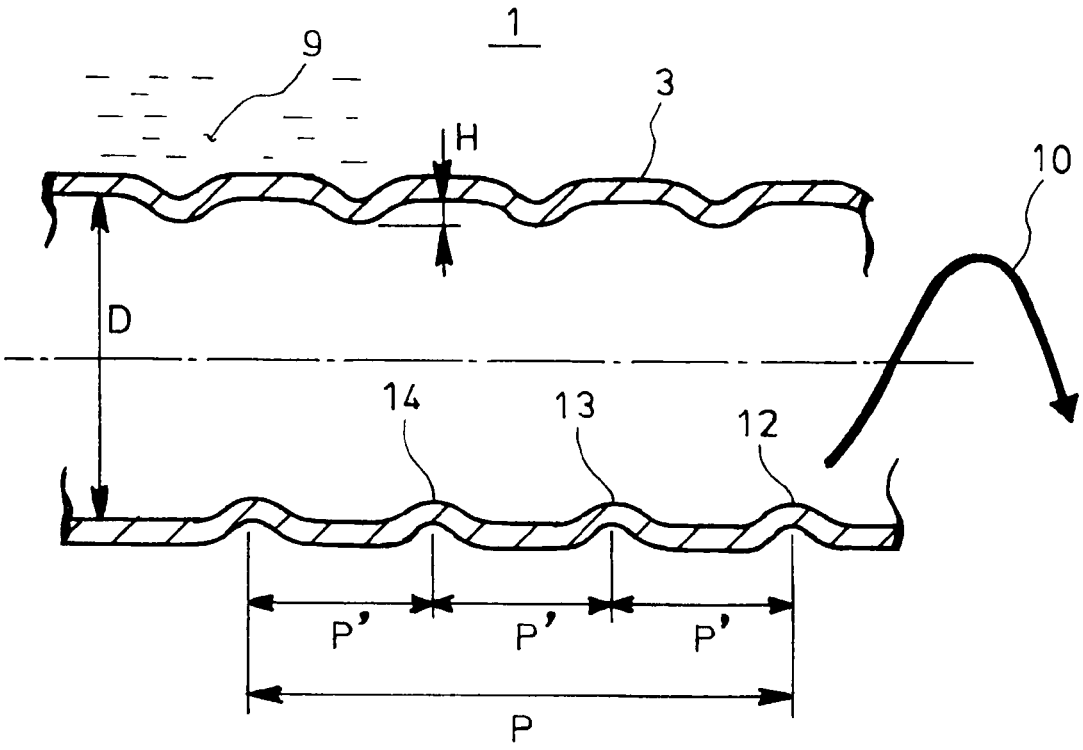
FIG. 3 is a sectional view showing the spiral protrusions in FIG. 2.

FIGS. 2 and 3 show the embodiment of the invention in which parts similar to those in FIG. 1 are designated by the same reference numerals.

As shown in FIG. 2, the embodiment is directed to an EGR cooler constructed substantially similarly to that has been explained with respect to FIG. 1, and an inner periphery of each of tubes 3 through which exhaust gas 10 flows is formed with three streaks of spiral protrusions 12, 13 and 14 running without crossing and with phases peripherally shifted at 120° to each other, a pitch P ratio (P/D) of each of the spiral protrusions 12, 13 and 14 to an inner diameter D of each of said tubes 3 being set to 2.0-4.0.

Upon formation of each of the spiral protrusions 12, 13 and 14, each of the tubes 3 may be spirally indented from outside by means of, for example, a roll with spiral convex streaks, so that portions pressed from outside provide the spiral protrusions 12, 13 and 13 on the inner periphery of the tube 3.

For setting, as shown in FIG. 3, the pitch P ratio (P/D) of each of spiral protrusions 12, 13 and 14 to the inner diameter D of each of the tubes 3 to 2.0-4.0, it is preferable that ridge height H of each of the spiral protrusions 12, 13 and 14 from the inner periphery of each of the tubes 3 has a ratio (H/D) to the inner diameter D of each of the tubes 3 set to 0.1-0.2.

Thus, such pitch P ratio (P/D) of each of the spiral protrusions 12, 13 and 14 to the inner diameter D of each of the tubes 3 set to 2.0-4.0 is slightly inferior in initial performance value on heat exchange efficiency to a pitch P ratio (P/D) of less than 2.0, but increases the tendency of each of the spiral protrusions slanting in the direction of flow of the exhaust gas 10 to keep and cause the exhaust gas 10 to have less pressure loss and to flow smoothly with tendency of the soot not to be accumulated on the inner periphery of each of the tubes 3, and therefore is superior in eventual performance value on heat exchange efficiency after final deterioration; in view of long use thereafter, it turns out that available is a prolonged time period with sufficient heat exchange efficiency being maintained.

Figure 4:
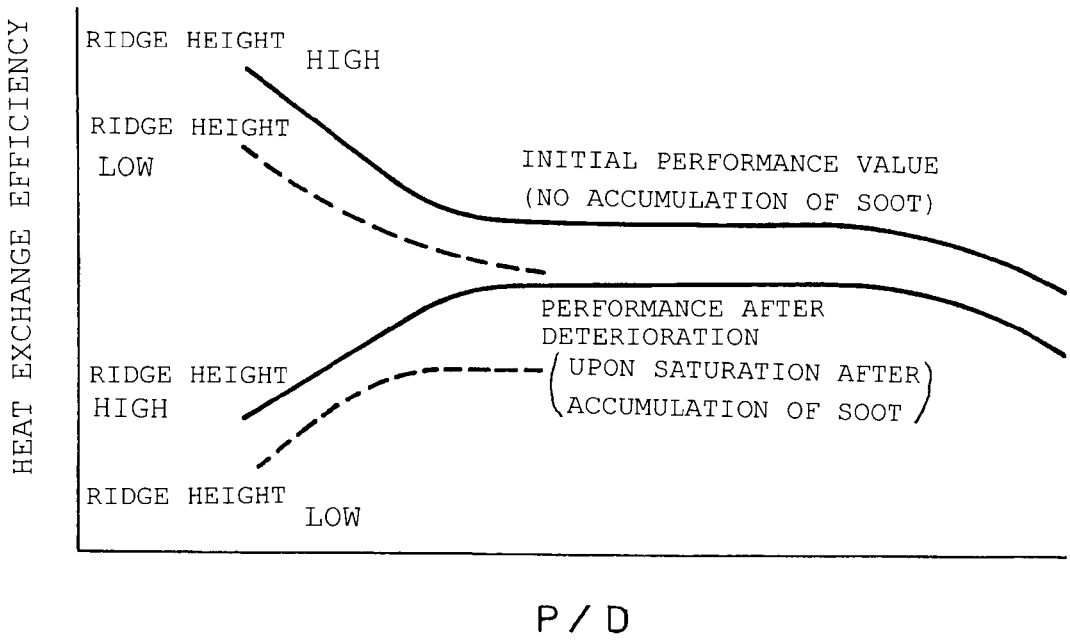
FIG. 4 is a graph showing a relationship between heat exchange efficiency and a pitch P ratio (P/D)

In fact, the inventors' experiments brought about the experimental results, for example, as graphically shown in FIG. 4 (which shows a relationship between heat exchange efficiency and P/D (a pitch P ratio of each of the spiral protrusions 12, 13 and 14 to inner diameter D of each of the tubes 3)). As is clear from the graph, it has been ascertained that, when the pitch P ratio (P/D) of each of the spiral protrusions 12, 13 and 14 to the inner diameter D of each of the tubes 3 is set to less than 2.0, increase in pressure loss cause the soot to be easily accumulated in the tubes 3, resulting in substantial lowering in performance, and that, with the pitch P ratio (P/D)

of each of the spiral protrusions 12, 13 and 14 being in a range of 2.0-4.0, performance value after final deterioration stays substantially flat.

Here, performance value after final deterioration will be explained. With lapse of time from start of using the EGR cooler, accumulation of the soot in the tubes 3 proceeds, which lowers heat exchange efficiency and increases pressure loss in the exhaust gas 10; eventually, a situation (saturation) is brought about where accumulation of the soot becomes not increased any more with the heat exchange efficiency and pressure loss being stabilized. Performance value in this situation is taken as performance value after final deterioration.

On the other hand, it has been ensured that even with the pitch P ratio (P/D) of more than 4.0, it hardly contribute to lowering in pressure loss of the exhaust gas while an amount of heat exchanged tends to be drastically decreased by slight increase in pitch P ratio (P/D) (a number of whirl of the exhaust gas 10 tends to be decreased due to over-collapse of the spiral protrusions 12, 13 and 14 in the direction of flow of the exhaust gas 10); moreover, insufficient whirling force afforded to the exhaust gas 10 excessively impairs the action of the soot entrained in the exhaust gas 10 gathering to the whirling axis, resulting inversely in a tendency of the soot to be accumulated on the inner periphery of each of the tubes 3.

FIG. 4 graphically shows differences of initial performance value and performance value after final deterioration between two examples of spiral protrusions 12, 13 and 14 higher and lower in ridge height H. With respect to the example lower in ridge height H, it has a tendency substantially similar to that of the example higher in ridge height H so that omitted is the graphic representation of the former after the pitch P ratio (P/D) exceeds 2.0 and the tendency of staying flat is ascertained.

By reviewing an EGR cooler with proper size on the basis of the above-mentioned experimental results and in due consideration to mountability in an engine room, it turns out that most effective optimal condition is to specify a pitch P ratio (P/D) of each of the spiral protrusions 12, 13 and 14 to the inner diameter D of each of the tubes 3 to 2.0-4.0.

Figure 5:
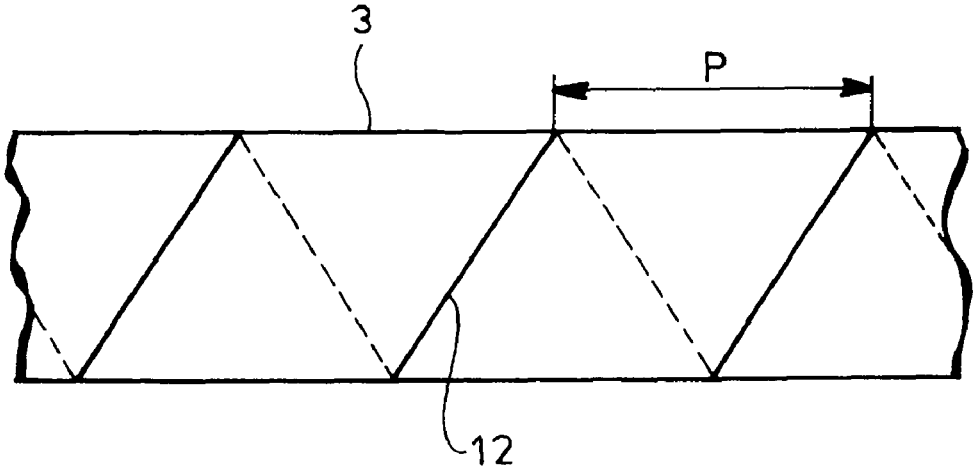
FIG. 5 is a view for explanation of a single spiral protrusion.
Figure 6:
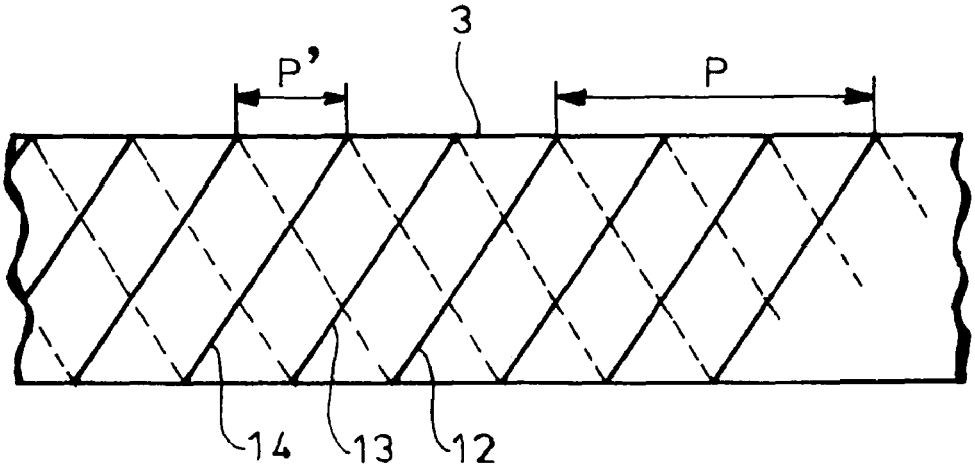
FIG. 6 is a view for explanation of three spiral protrusions.

When the pitch P ratio (P/D) of the spiral protrusions 12, 13 and 14 to the inner diameter D of each of the tubes 3 is set to 2.0-4.0 and if, as schematically shown in FIG. 5, a single streak of spiral protrusion 12 were applied, then axial pitch P of the spiral protrusion 12 would inevitably spatial with no spiral protrusion; as schematically shown in FIG. 6, if there are three streaks of spiral protrusions 12, 13 and 14, then while the pitch P ratio (P/D) of each of the spiral protrusions 12, 13 and 14 is set to more than 2.0, axial mutual distance P' between the spiral protrusions 12, 13 and 14 can be shortened to thereby increase the whirling force of the exhaust gas 10 with no increase in pressure loss.

Theoretically, the more the number of streaks of spiral protrusions 12, 13 and 14 is, the more they work effectively. However, to machine three streaks is actual limitation in current machining technology. It is conceivable that, at a practical level, to make three streaks of spiral protrusions 12, 13 and 14 can maximize the performance value after final deterioration.

Figure 7:
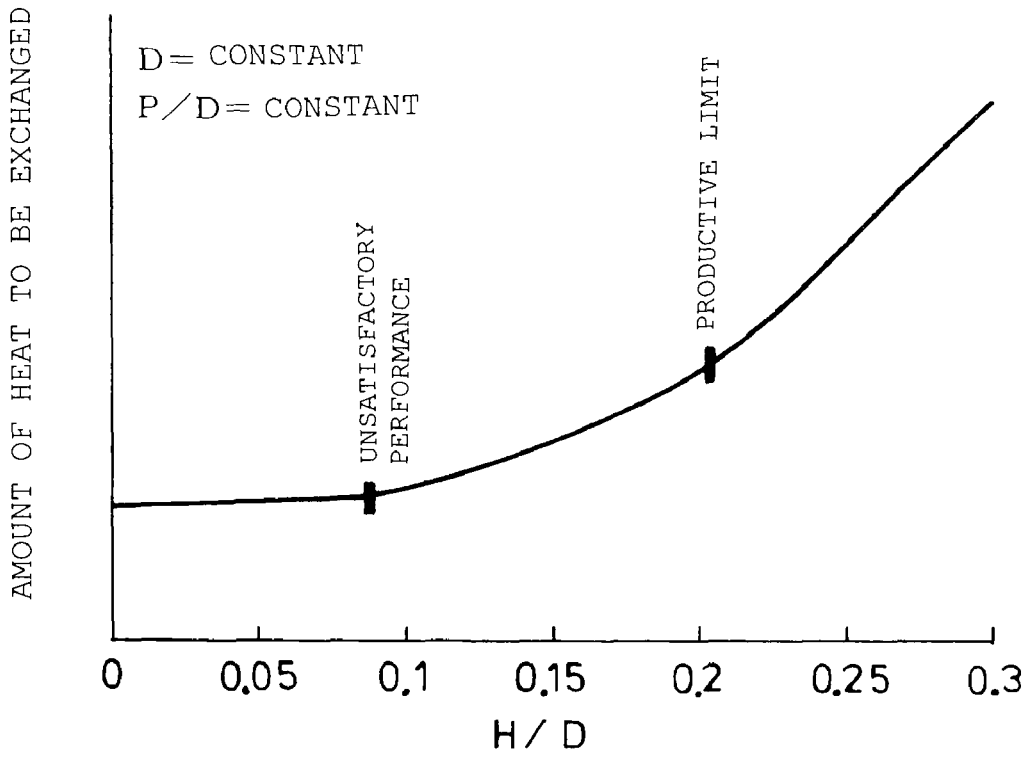
FIG. 7 is a graph showing a relationship between an amount of heat to be exchanged and a ratio of ridge height H (H/D).

Further, when the pitch P ratio (P/D) of each of the spiral protrusions 12, 13 and 14 is set to 2.0-4.0, it is preferable, as graphically shown in FIG. 7, that a ridge height H ratio (H/D) of each of the spiral protrusions 12, 13 and 14 to the inner diameter D of each of the tubes 3 is set to 0.1-0.2. It has been ascertained by the inventors that, with the ridge height H ratio (H/D) being less than 0.1, whirling flow of the exhaust gas 10 is hard to be sufficiently formed, resulting in lowering of an amount of heat exchanged to a minimum level; to increase the ridge height H ratio (H/D) to more than 0.2 is actually unattainable due to productive limitation.

Thus, according to the embodiment, for improvement in heat exchange efficiency by means of the whirling flow of the exhaust gas 10 in the tubes 3, the pitch P ratio (P/D) of each of the spiral protrusions 12, 13 and 14 to the inner diameter D of each of the tubes 3 is set to 2.0-4.0 and the ridge height H ratio (H/D) of each of the spiral protrusions 12, 13 and 14 to the inner diameter D of each of the tubes 3 is set to 0.1-0.2. As a result, the soot is suppressed from being accumulated on the inner periphery of each of the tubes 3 to keep performance value higher after final deterioration in comparison with an EGR cooler with a conventional design concept merely focusing attention on initial performance value, so that an EGR cooler is provided which is satisfactorily applicable to a diesel engine with highly sooty exhaust gas being discharged with no substantial lowering in performance.

Especially in the embodiment, the inner periphery of each of the tubes 3 is formed with three streaks of spiral protrusions 12, 13 and 14 running without crossing and with phases peripherally shifted to each other. This enables the mutual distance P' between the respective spiral protrusions 12, 13 and 14 to be decreased with the pitch P ratio (P/D) of each of the spiral protrusions 12, 13 and 14 being more than 2.0, whereby whirling force of the exhaust gas 10 can be increased without increasing the pressure loss.

It is to be understood that an EGR cooler according to the invention is not limited to the above embodiment and that various changes and modifications may be made without leaving the spirit of the invention.

The invention claimed is:

1. An exhaust gas recirculation (EGR) cooler, comprising:

a plurality of tubes; and a shell which encloses said tubes, cooling water being supplied to and discharged from said shell during use of the EGR, exhaust gas being guided from a diesel engine into said tubes to be heat exchanged with said cooling water during use of the EGR, wherein an inner periphery of each of said tubes is formed with three streaks of spiral protrusions running without crossing and with phases peripherally shifted or displaced with each other, a pitch ratio of each of said spiral protrusions to an inner diameter of each of said tubes being 2.0-4.0, a ridge height ratio of each of said spiral protrusions to said inner diameter of each of said tubes being 0.1-0.2, and wherein a pitch of a respective one of the spiral protrusions is an axial length between neighboring points within the same phase on the respective one of the spiral protrusions, and the inner diameter of each of the tubes is an internal diameter of the tubes measured at a point within the tubes that does not include any spiral protrusions.

* * * * *